US005381855A

United States Patent [19]

Mezger

[11] Patent Number: 5,381,855

[45] Date of Patent: Jan. 17, 1995

[54] METHOD OF AND APPARATUS FOR CONTROLLING THE MOTION OF A POURING LADLE

[75] Inventor: Fritz Mezger, Muntelier, Switzerland

[73] Assignee: Maschinenfabrik & Eisengiesserei Ed. Mezger AG, Kallnach, Switzerland

[21] Appl. No.: 131,764

[22] Filed: Oct. 4, 1993

[30] Foreign Application Priority Data

Oct. 7, 1992 [CH] Switzerland ..... 03135/92

[51] Int. Cl.[6] ..... B22D 37/00; B22D 41/06

[52] U.S. Cl. ..... 164/457; 164/4.1; 164/136; 164/155.1; 164/155.7; 164/335; 222/590; 222/604

[58] Field of Search ..... 164/136, 335, 336, 4.1, 164/457, 155.1, 155.7; 222/590, 604, 605

[56] References Cited

U.S. PATENT DOCUMENTS

| | | | |
|---|---|---|---|
| 1,749,083 | 3/1930 | Morris et al. . | |
| 2,463,811 | 3/1949 | Schulze | 222/604 |
| 2,892,225 | 6/1959 | Buhrer et al. | 164/336 X |
| 4,112,998 | 9/1978 | Sato | 164/136 |

FOREIGN PATENT DOCUMENTS

| | | | |
|---|---|---|---|
| 1011082 | 5/1977 | Canada | 164/335 |
| 0163261 | 12/1985 | European Pat. Off. . | |
| 606988 | 12/1934 | Germany . | |
| 61-229463 | 10/1986 | Japan | 164/335 |
| 2058624A | 4/1981 | United Kingdom . | |
| 223273 | 10/1968 | U.S.S.R. | 164/136 |
| 326021 | 3/1972 | U.S.S.R. | 164/335 |

*Primary Examiner*—C. Reed Batten, Jr.
*Attorney, Agent, or Firm*—Ostrolenk, Faber, Gerb & Soffen

[57] ABSTRACT

The pouring ladle can not only be tilted by a tilting drive and a cable around a permanent tilting axis in order to pour the molten metal in a mould, respectively to interrupt the pouring process, but the tilting axis can be lifted and lowered by a determined value by a lifting drive. By lifting and lowering the tilting axis, the tilting motion of the pouring ladle takes place approximately in the center of gravity of the molten metal. This permits to avoid compensating streams and wave motions of the molten metal when the pouring ladle tilts forward and backward and more definite and reliable processes are achieved, capable to be controlled, at the start of pouring and at the time of terminating the pouring. The lifting drive and the tilting drive can be utilized for further lifting the pouring ladle in order to advance the pouring ladle further toward the center of the mould at the first pouring process under holding a determined distance of security from the mould.

12 Claims, 2 Drawing Sheets

FIG. 3
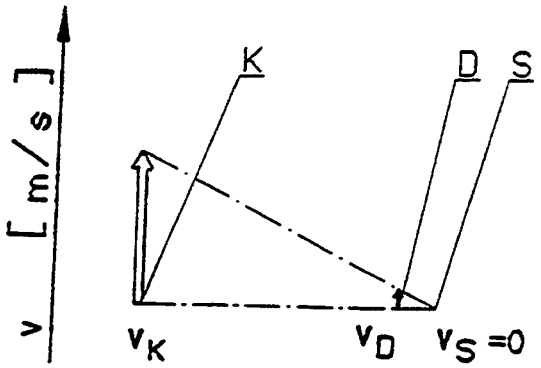
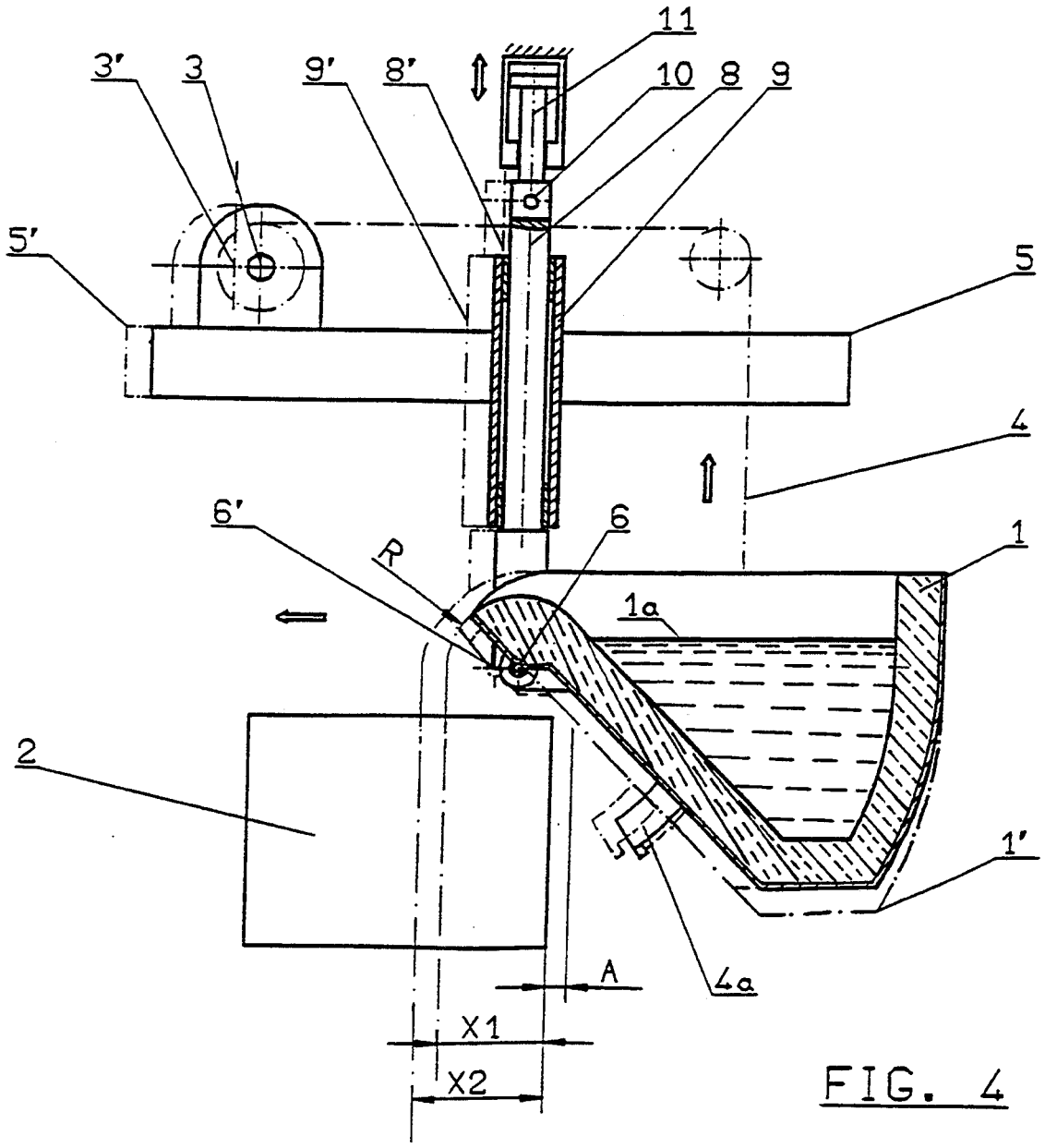
FIG. 4

METHOD OF AND APPARATUS FOR CONTROLLING THE MOTION OF A POURING LADLE

BACKGROUND OF THE INVENTION

The present invention relates to a method for controlling the motion of a pouring ladle by means of two elevating devices, the real, respectively virtual axis around which the pouring ladle is tilted during the pouring operation being in the center of the radius of the outlet opening. Existing automatic pouring installations for repeated controlled filling of liquid metals from a pouring ladle in moulds presented one after the other are working as follows: The molten mass flows during the pouring over a spout of radius R from the ladle, the axis of tilting of the ladle passing approximately through the center of this radius such that independently of the angle of tilting of the ladle, approximately the same geometrical relations and thus the same characteristics of flow are provided. The tilting takes place by means of a controlled drive which engages the ladle through mechanical connecting members. For controlling this tilting drive, measuring probes can be foreseen and/or the pouring process can be largely fixed programmed. With such devices one obtains in fact a perfect course of the pouring process at the beginning, during the pouring, and at its end. However, three problems arise in installations in which moulds are automatically filled in a succession as rapid as possible. First, a relatively great quantity of liquid metal continues to flow after the signal "end of pouring" has been received from the control system, that system which initialize the tilting back, until the pouring stream definitely ceases. Second, the reverse effect arises also at the beginning of pouring, which means that when the signal "start of pouring" is given, it takes still a relatively long time until a uniform, controlled stream flows. These two conditions have the effect of sensibly prolonging the time of pouring. Third, due to the motions around the axis of tilting, streaming motions, respectively wave motions take place in the liquid metal contained in the pouring ladle which during the rapid back tilting and again forward tilting of the pouring ladle between two successive pouring processes never come to rest and at least at the beginning of each pouring process influence the streaming of the liquid metal which hinders or renders more difficult a sure control of the pouring process. One was therefore forced to introduce between the end of pouring and the beginning of pouring a waiting time of at least two to three seconds because otherwise the control process was too much disturbed.

SUMMARY OF THE INVENTION

It is an object of the present invention, without disturbing the control process, one the one hand, to reduce the pouring time for a mould, on the other hand, to reduce also the time between the filling of two moulds and thus to increase the cadence of the pouring of the moulds. These problems are solved by a method according to the invention, in which for initializing and terminating the pouring, the real, respectively virtual axis is at least approximately displaced in the center of gravity of the molten metal. With respect to known methods, the following advantages are ensured: On the one hand, the liquid metal has a greater tilting angle for a same value of elevation of the pouring spout which leads to a rapid flow back and thus a rapid end of pouring as well as a rapid forward flow and thus a more rapid beginning of the pouring.

On the other hand, the liquid metal is much less accelerated, respectively braked or, differently formulated, there is much less kinetical energy introduced in the molten metal so that the wave motions are decidedly decreased.

A particularly simple measure according to the invention consists in that for tilting the pouring ladle around the center of gravity of the liquid metal, the axis of tilting is lifted, respectively lowered.

This leads to a particularly simple constructive solution this being also an object of the invention. The pouring installation comprises a pouring ladle which is controllable by means of two elevating devices of which the one engages at the outlet opening and the other at the other side of the pouring ladle, and with a common control system of the motion for both elevating devices, characterized in that both elevating motions are so coordinated that the pouring ladle at the beginning and the end of the pouring is tilted at least appoximately in the center of gravity of the molten metal. It is known to foresee two elevating drives for the pouring ladle (DE-C-606 988). These drives serve however only to couple the pouring ladle with the mould and to tilt the mould with the pouring ladle in such a way that a direct connection between the liquid metal in the pouring ladle and the mould always exists.

The invention relates finally to an advantageous utilization of the installation in the sense that the tilting drive and the elevating device of the installation are controlled in common for an additional lifting of the pouring ladle essentially without tilting motion. This renders possible to additionally lift the pouring ladle, and by holding a sufficient distance of security from the mould, to advance the pouring ladle relatively near toward the middle of this mould and then to initialize the pouring process.

BRIEF DESCRIPTION OF THE DRAWINGS

The invention will be explained more in detail by means of the drawings:

FIG. 3 is a diagram for explaining the course of motion when tilting the pouring ladle, and FIG. 4 is an illustration corresponding to FIG. 2 of the pouring installation and serves to explain a particular utilization, respectively manner of working of the installation.

DESCRIPTION OF THE PREFERRED EMBODIMENT

Figure 1:
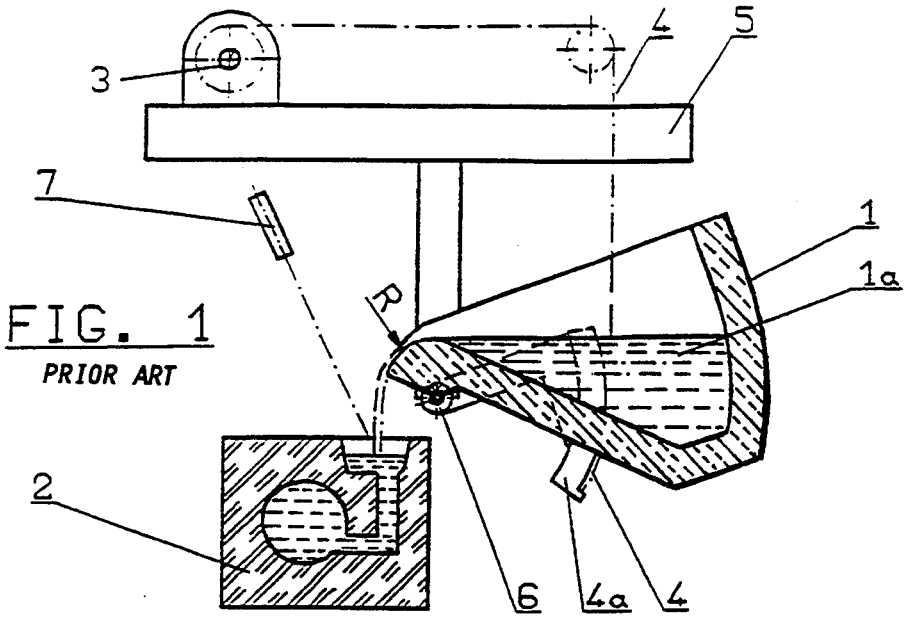
FIG. 1 PRIOR ART
FIG. 1 shows a section through a known pouring installation.

FIG. 1 shows more or less schematically a prior-art pouring installation with a tiltable pouring ladle 1 which contains the liquid or molten metal 1*a*. FIG. 1 shows the condition in which a mould 2 has just been filled with liquid metal 1*a*, the pouring process having to be terminated by backward tilting of the pouring ladle. This backward tilting takes place in that a tilting drive 3 which engages over a cable 4, is tilted around a tilting axis 6. Contrary to the schematic illustration in FIG. 1, the pouring ladle 1 is normally exchangeably introduced in a frame to which the segment 4*a* and the axis of tilting 6 are mounted. The tilting drive 3 and the axis of tilting are mounted in a frame 5. The outlet opening or outlet groove of the pouring ladle 1 comprises a radius R with respect to the axis of tilting 6. FIG. 1 shows further a sensor 7 for ascertaining when the liquid metal rises in the pouring funnel which indicates that the pouring process must be terminated.

As mentioned, for terminating the pouring process, the pouring ladle is tilted backward, clockwise around the tilting axis 6 by means of the tilting drive 3 through the cable 4 so that no more liquid metal can stream into the mould 2. From FIG. 1 it is clearly seen that during this tilting motion, practically the full volume of liquid metal 1*a* lies laterally offset from the tilting axis 6 and thus is entirely submitted to an important acceleration downwards. By experience, one shows that this leads to important oscillations respectively wave motions of the liquid metal. When, slightly later, the pouring ladle 1 is tilted forward anticlockwise in order to fill liquid metal into the next mould 2, this important wave motion is further increased and leads to an irregular, not controlled run out of the liquid metal.

Figure 2:
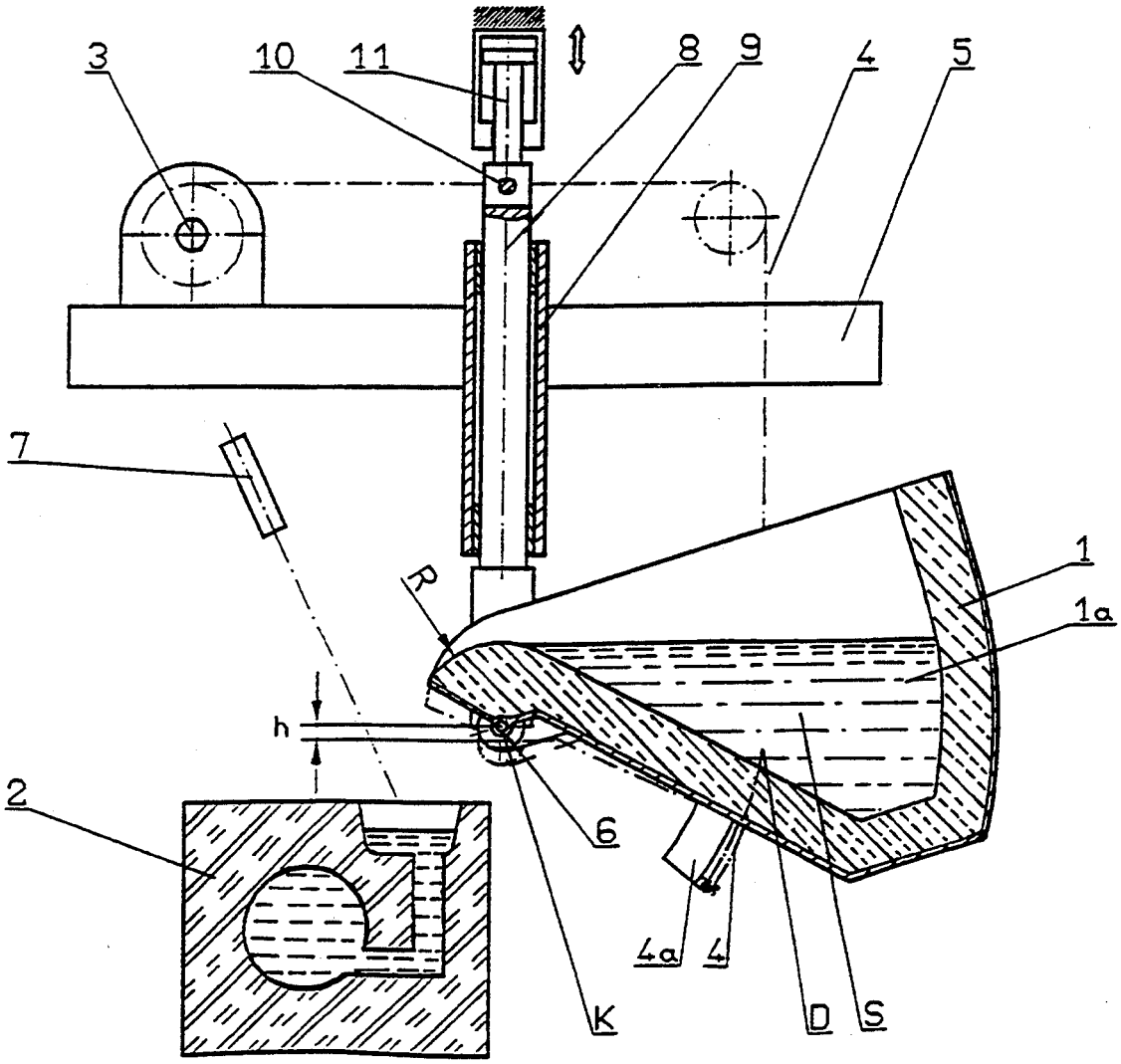
FIG. 2 is a section through a pouring installation according to the invention.

This drawback is avoided in the installation according to the present invention, see FIG. 2. In FIG. 2, corresponding parts are designated by the same reference numbers as in FIG. 1. The difference is that the tilting axis 6 is no more fixed in the frame of the machine. The tilting axis 6 is fastened to lateral supports 8 which are vertically displacable in guides 9. At the top 10, the support 8 engages the piston rod 11 of a hydraulic drive cylinder which permits to lift and lower vertically the supports 8 with the tilting axis 6 as shown by the arrow. This lifting motion is indicated in FIG. 2, that is the drawing shows the tilting axis 6 in the upper end position from which it can be lowered by a value h to a lower position indicated by a dot-and-dash line.

This additional lifting motion of the pouring ladle permits to leave the tilting motion of the pouring ladle at the time of starting and terminating the pouring process relatively near to the center of gravity of the liquid metal. In FIG. 2, the tilting axis is additionally designated by K, the point of application of the cable 4 at the sector 4*a* by D and the center of gravity of the liquid metal by S. FIG. 3 shows the conditions at the time of tilting back the pouring ladle for terminating a pouring process. The control of the motion takes place in that the tilting axis 6 is lifted with a speed $V_K$, the cable 4, on the other hand with a speed $V_D$. From the diagram in FIG. 3, is seen that in this case, in the center of gravity S of the liquid metal, no vertical motion takes place. Thus the tilting motion takes place practically in the center of gravity of the liquid metal , which leads to the above mentioned advantages. When the pouring ladle is tilted forwards for starting the next pouring process, the motions run off in the reverse direction, whereby the way at the location D can correspondingly be somewhat smaller in order for the pouring ladle to be additionally tilted forward. The relatively rapid lifting, lowering of the tilting axis 6, respectively of the pouring spout has the further advantage that a pouring process is more rapidly terminated and that also the start of a new pouring process takes place more rapidly without the disadvantages of known installations The shape of the pouring ladle 1 is chosen so that the position of the center of gravity S for different contents of the pouring ladle is not considerably displaced in the horizontal direction, so that no fundamental control system of the course of the motion in function of the content of the ladle is by all means necessary. It is however quite possible, as a function of the shape of the ladle and of the necessary requirements, to determine the quantity of the molten metal contained in the pouring ladle, this being well-known practice with prior installations, and to regulate the control of the motion of the lifting of the tilting axis 6 and of the tilting drive 3 according to determined parameters in function of the content of the ladle, so that the virtual tilting axis lies still near to the center of gravity S. It is to be noted that a displacement of the tilting axis of the pouring ladle with respect to the real tilting axis 6 resulting in a virtual tilting axis in the center of gravity S in the horizontal and vertical direction is practically difficult to realize. Decisively and capable to be realized is a displacement in the horizontal direction, in a position near to a vertical line through the center of gravity S of the liquid metal. A certain deviation in the vertical direction is unimportant for the practical working.

FIG. 4 corresponds largely to FIG. 2, whereby corresponding parts are designated by the same references. In FIG. 4, a lower position of the pouring ladle 1 is designated by 1'. When pouring, the pouring ladle must hold a minimal distance A with respect to the mould 2. With this lower position of the ladle and the pouring spout respectively the pouring stream may only be approached by the value X1 toward the middle of the mould if one wants to hold the distance of security A. If one lifts the entire pouring ladle from this lower position to the upper position illustrated in full lines, then it is obvious that whilst maintaining the distance of security A, the tilting axis and thus the pouring spout enters with the value X2 nearly into the middle of the mould 2. The position thus attained by the tilting axis is indicated by 6' in a dot-and-dash line. It is then possible to realize a corresponding displacement of the support 5 of the tilting drive 3 of the guide 9 and of the support 8 into a position 5', 3', 9', respectively 8' displaced toward the left. The lifting drive for the tilting axis 6 thus permits to utilize this possibility in a simple way in that the pouring ladle 1 is altogether lifted in a motion of translation, in order for the pouring ladle to come nearer to the middle of the mould. Later on, when the pouring ladle is tilted further, one can lower the latter again into the normal position and control, as described above, the lifting drive and the tilting drive according to the usual program.

I claim:

1. An apparatus for pouring molten metal with a pouring ladle which comprises:

two lifting devices, one of which engages the pouring ladle at an outlet opening and the other one of which engages the pouring ladle at a side of the pouring ladle away from the outlet opening; and, a common control system for controlling simultaneously the two lifting devices, wherein motions of each of the two lifting devices are controlled such that the pouring ladle at a start and a termination of pouring is tilted around a tiltings axis at least approximately in a center of gravity of the molten metal contained within the ladle.

2. An apparatus according to claim 1, further comprising means for determining the quantity of the molten metal contained in the pouring ladle, means for determining the center of gravity of the quantity of molten metal contained in the pouring ladle, and means for controlling the motion of the ladle as a function of the center of gravity of the quantity of molten metal.

3. An apparatus according to claim 1, in which a shape of the pouring ladle is selected such that a horizontal position of the center of gravity of the molten metal contained within the ladle remains substantially unchanged with respect to a quantity of molten metal contained within the ladle.

4. An apparatus according to claim 1, in which the other one of the lifting devices engages the pouring ladle at a location between the spout and an axis through the center of gravity of the molten metal contained within the ladle.

5. A method for controlling the motion of a tiltable pouring ladle, the method comprising the steps of:

a) starting a pouring operation by tilting the ladle around a first tilting axis which substantially coincides with an axis through a center of gravity of the pouring ladle contents;

b) continuing the pouring operation by tilting the ladle around a second tilting axis located at a center of a radius of a ladle spout; and c) terminating the pouring operation by tilting the ladle around the first tilting axis.

6. A method according to claim 5, wherein the step a) of starting the pouring operation comprises lowering the spout with respect to the first tilting axis using a first lifting means attached to the ladle at the spout, and the step c) of terminating the pouring operation comprises lifting the spout with respect to the first tilting axis using the first lifting means.

7. A method according to claim 6, wherein the step of starting the pouring operation further comprises lowering the ladle with a second lifting means attached to the ladle at a side of the ladle away from the spout and at a location between the spout and the axis through the center of gravity of the pouring ladle contents, and the step of terminating the pouring operation comprises lifting the ladle with the second lifting means.

8. A method according to claim 7, wherein in the step a) of starting the pouring operation, the center of gravity of the ladle contents remains in a fixed vertical position.

9. A method according to claim 7, wherein in the step c) of terminating the pouring operation, the center of gravity of the ladle contents remains in a fixed vertical position.

10. A method according to claim 5, further comprising the steps of determining a quantity of the contents within the ladle, defining the center of gravity of the pouring ladle contents based on the quantity determined, and controlling the tilting based on the quantity determined and the defined center of gravity.

11. A method according to claim 5, further comprising the step of changing a vertical position of the ladle without tilting the ladle, so as to orient the ladle, with respect to a mould which receives the ladle contents, during the pouring operation.

12. A method according to claim 5, wherein the step a) of starting the pouring operation comprises lowering the second tilting axis, and the step c) of terminating the pouring operation comprises lifting the second tilting axis.

* * * * *